US010239659B2

(12) United States Patent
Meroz

(10) Patent No.: US 10,239,659 B2
(45) Date of Patent: Mar. 26, 2019

(54) CONTAINER AND CONSTRUCTION MADE THEREFROM

(71) Applicant: Gilead Meroz, Herzliya (IL)

(72) Inventor: Gilead Meroz, Herzliya (IL)

( * ) Notice: Subject to any disclaimer, the term of this patent is extended or adjusted under 35 U.S.C. 154(b) by 83 days.

(21) Appl. No.: 15/126,290

(22) PCT Filed: Mar. 16, 2015

(86) PCT No.: PCT/IB2015/051911
§ 371 (c)(1),
(2) Date: Sep. 15, 2016

(87) PCT Pub. No.: WO2015/140694
PCT Pub. Date: Sep. 24, 2015

(65) Prior Publication Data

US 2017/0081076 A1 Mar. 23, 2017

Related U.S. Application Data

(60) Provisional application No. 61/953,767, filed on Mar. 15, 2014.

(51) Int. Cl.
*B65D 21/028* (2006.01)
*B65D 21/02* (2006.01)
(Continued)

(52) U.S. Cl.
CPC ..... *B65D 21/0204* (2013.01); *B65D 1/0246* (2013.01); *B65D 21/0201* (2013.01); *B65D 21/022* (2013.01); *B65D 41/04* (2013.01)

(58) Field of Classification Search
CPC ..... B65D 21/0201; B65D 21/0204; B65D 21/022; B65D 1/0246; B65D 41/06; B65D 21/023; B65D 21/0202; B65D 21/0216; B65D 21/0231; B65D 21/02; B65D 2501/0081
(Continued)

(56) References Cited

U.S. PATENT DOCUMENTS 4,860,896 A * 8/1989 Snider ..... A63H 33/04 206/427
2006/0261063 A1 11/2006 Dyehouse
(Continued)

FOREIGN PATENT DOCUMENTS

CN 103298702 A 9/2013
WO 2002012077 A2 2/2002
(Continued)

*Primary Examiner* — Fenn C Mathew
*Assistant Examiner* — Elizabeth J Volz
(74) *Attorney, Agent, or Firm* — Alphapatent Associates, Ltd; Daniel J. Swirsky

(57) ABSTRACT

A container for receiving therein a liquid is provided. The container comprises an upper portion, a lower portion opposite thereto, and sidewalls extending therebetween and all defining an enclosed volume therewithin. The upper portion comprises an opening to the volume. The container further comprises a cap configured to be secured to the upper portion for closing the enclosed volume. The upper portion is configured to be connected to the lower portion. The sidewalls are associated with one or more arrangements configured to facilitate connection to sidewalls of similarly constructed containers.

17 Claims, 8 Drawing Sheets

(51) Int. Cl.
*B65D 1/02* (2006.01)
*B65D 41/04* (2006.01)

(58) Field of Classification Search
USPC ..... 220/23.4, 23.6, 23.83, 669; 215/10, 329, 215/382; 206/504, 511, 509; 428/33
See application file for complete search history.

(56) References Cited

U.S. PATENT DOCUMENTS

| | | | | |
|---|---|---|---|---|
| 2009/0045157 | A1 | 2/2009 | Panchal et al. | |
| 2009/0255893 | A1* | 10/2009 | Zummo ..... | B65D 1/0223 215/10 |
| 2012/0118848 | A1 | 5/2012 | Hendrickson et al. | |
| 2012/0325718 | A1 | 12/2012 | Larsen | |
| 2013/0213846 | A1* | 8/2013 | Hendrickson ..... | B65D 21/0216 206/509 |

FOREIGN PATENT DOCUMENTS

| | | | |
|---|---|---|---|
| WO | 2012045061 | A2 | 4/2012 |
| WO | 2012160222 | A1 | 11/2012 |

* cited by examiner

CONTAINER AND CONSTRUCTION MADE THEREFROM

CROSS-REFERENCE TO RELATED APPLICATIONS

This application is a U.S. National Phase Application under 35 U.S.C. 371 of International Application No. PCT/IB2015/051911, which has an international filing date of Mar. 16, 2015, and which claims priority and benefit from U.S. Provisional Patent Application No. 61/953,767, filed Mar. 15, 2014, the contents and disclosure of which are incorporated herein by reference in their entirety.

FIELD OF THE INVENTION

The present disclosure relates to container, and in particular to containers which may be reused for construction.

BACKGROUND OF THE INVENTION

The modern consumption-driven society, the density of the population coupled with industrialization and advancement of technology results in producing waste, hazardous and non-hazardous. Hazardous waste is dangerous or potentially harmful to our health or the environment, while non-hazardous waste (garbage) consists of everyday items we use and then throw away, such as product packaging, bottles, food scraps, and newspapers. Nearly everything we do leaves behind some kind of waste.

The awareness to the environment and the possible ecological damage amplified the importance of waste handling as an increasingly important environmental and aesthetic issue for households, corporations, municipalities and nations, promoting the agenda of "Reduce, Reuse and Recycle". The 3R's presents the waste hierarchy aiming at different desirable outcomes of waste management. The aim of the waste hierarchy is to extract the maximum practical benefits from products and to generate the minimum amount of waste.

The high consumption of single-use bottled beverages, especially the growth rate in consuming plastic water bottles, present a huge environmental problem. Even though recycling programs exist, the recycling rate is extremely low causing about 80% of the plastic containers to end up in the landfill.

In practice, the recycling process presents difficulties and the scope of its contribution to environment is unclear. Large quantities of plastic containers, especially plastic bottles, are not recycled. Recycling is a regulation-based solution not necessarily profitable and may be considered economically unjustifiable causing more pollution. When compared to other materials like glass and metal, plastic polymers require greater processing (heat treating, thermal de-polymerization and monomer recycling) to be recycled. Furthermore, the chemical properties of the plastic bottles, in particular the raw material of polyethylene terephthalate (PET), and the high ratio of its volume to weight, add to the complexity of the recycling process. Public pressure urges manufacturers to search for "solutions" which are both economical and socio-environmental.

Several devices currently exist to facilitate improved re-use of plastic containers or plastic bottles as raw material for building and forming multi-purpose structuring.

SUMMARY OF THE INVENTION

According to one aspect of the presently disclosed subject matter, there is provided a container for receiving therein a liquid, the container comprising an upper portion, a lower portion opposite thereto, and sidewalls extending therebetween and all defining an enclosed volume therewithin, the upper portion comprising an opening to the volume; the container further comprising a cap configured to be secured to the upper portion for closing the enclosed volume; wherein the upper portion is configured to be connected to the lower portion; and wherein the sidewalls are associated with one or more arrangements configured to facilitate connection to sidewalls of similarly constructed containers.

The upper portion may comprise an upper closing arrangement configured to cooperate with the cap for facilitating its securing thereon and an upper connecting arrangement, wherein the lower portion comprises a lower connecting arrangement configured to cooperate with the upper closing arrangement to facilitate its connection to the upper portion.

The upper connecting arrangement may comprise a radially-protruding lip, with the lower connecting arrangement comprising a plurality of inwardly-biased tabs.

The tabs may be disposed within a cavity formed within the lower portion, and configured to receive therein at least a top portion of the upper portion.

The tabs may each comprise an upper edge, the upper edges defining a shelf having a smaller diameter than the lip.

The upper connecting arrangement may be disposed below the upper closing arrangement.

The arrangements associated with the sidewalls may comprise complementary sidewall connecting elements configured to facilitate the connection to sidewalls associated with similarly constructed arrangements.

The sidewall connecting elements may comprise at least one of a male and a female connecting element, wherein the male connecting element comprises a carrying member protruding laterally from the sidewall and having at least one rounded protuberance protruding laterally therefrom, and wherein the female connecting element comprises one or more sockets configured to receive therein at least the protuberances of a male connecting element, thereby facilitating the connection to sidewalls of similarly constructed containers.

The male connecting element may comprise a rounded protuberance protruding in one of an upward and downward direction from the carrying member.

The male connecting element may comprise two rounded protuberances, one protruding in an upward direction from the carrying member, and one protruding in an upward direction from the carrying member.

The container may have a major cross-sectional shape suitable for tessellating and being formed with beveled vertices giving rise to fillets, wherein the sidewall connecting elements are disposed projecting from the fillets.

The sidewall connecting elements may comprise at least one of a male and a female connecting element, wherein the male connecting element comprises a tab, and the female connecting element comprises a slot configured to receive therein the male connecting element.

The tab may be directed in one of an upward and downward direction.

The container may comprise both male and female connecting elements.

The container may comprise an even number of sidewall connecting elements disposed at a similar height of the container, wherein the sidewall connecting elements alternate between male and female sidewall connecting elements.

The sidewall connecting elements may be formed on a band element snugly disposed about a circumference of the container.

The container may be formed with one or more circumferential channels, each configured to receive therein the band element. The channel and band element may be configured such that the band element is flush with the adjacent sidewall of the container when received within the channel.

The channel may be formed so as to prevent vertical sliding of the band element when received therein. For example, the channel may be defined between top and bottom edges formed as downwardly and upwardly facing shelves.

The container may further comprise depressions intersecting with the channel, wherein the band element is formed such that the sidewall connecting elements thereof lie in registration over the depressions when snuggly disposed about the container within the channel.

The container may comprise therewithin the liquid.

According to another aspect of the presently disclosed subject matter, there is provided a construction made of a plurality of containers according to the above, connected to one another.

BRIEF DESCRIPTION OF THE DRAWINGS

For a better understanding of the embodiments and to show how it may be carried into effect, reference will now be made, purely by way of example, to the accompanying drawings.

With specific reference now to the drawings in detail, it is stressed that the particulars shown are by way of example and for purposes of illustrative discussion of selected embodiments only, and are presented in the cause of providing what is believed to be the most useful and readily understood description of the principles and conceptual aspects. In this regard, no attempt is made to show structural details in more detail than is necessary for a fundamental understanding; the description taken with the drawings making apparent to those skilled in the art how the several selected embodiments may be put into practice. In the accompanying drawings.

DETAILED DESCRIPTION OF EMBODIMENTS

Figure 1A:
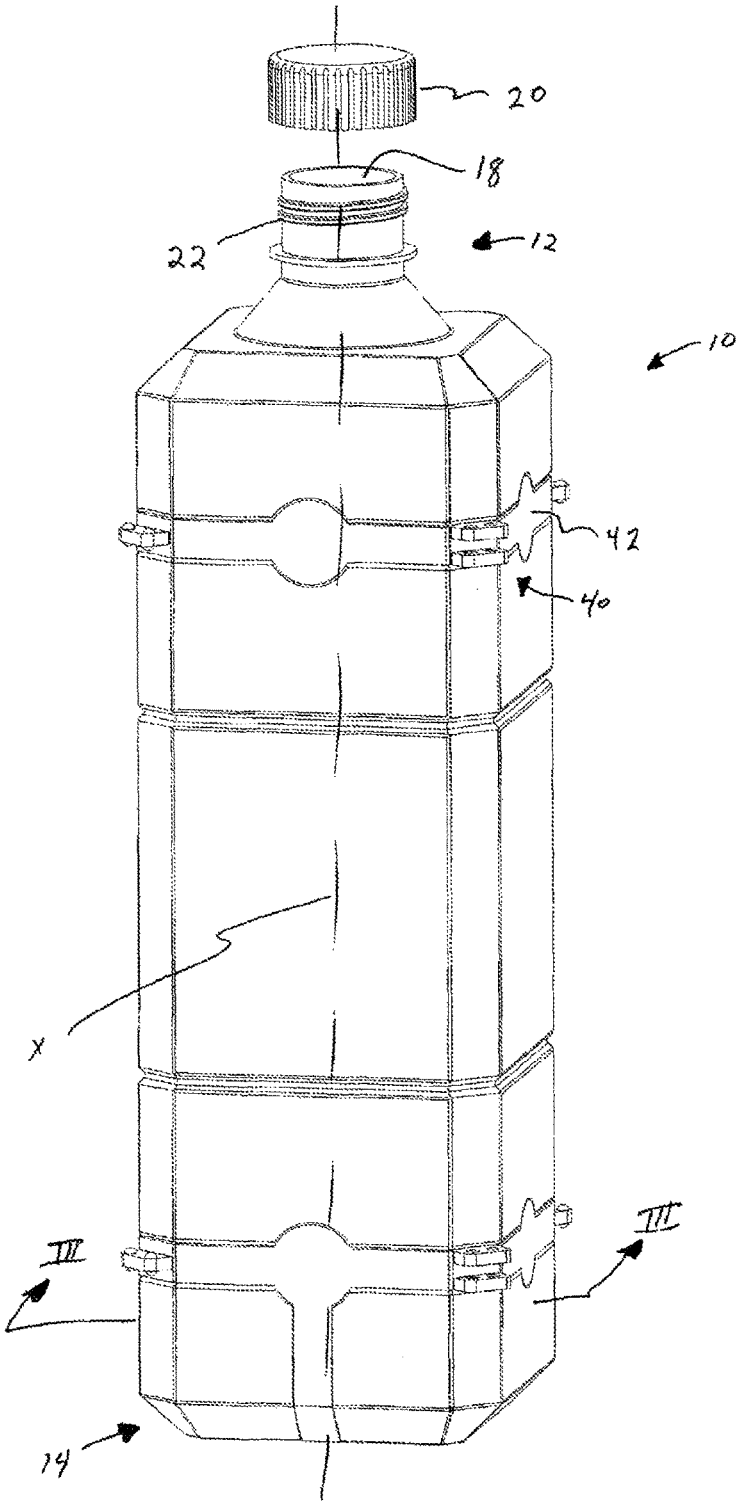
FIGS. 1A and 1B are perspective views of examples of a container according to the presently disclosed subject matter.
Figure 1B:
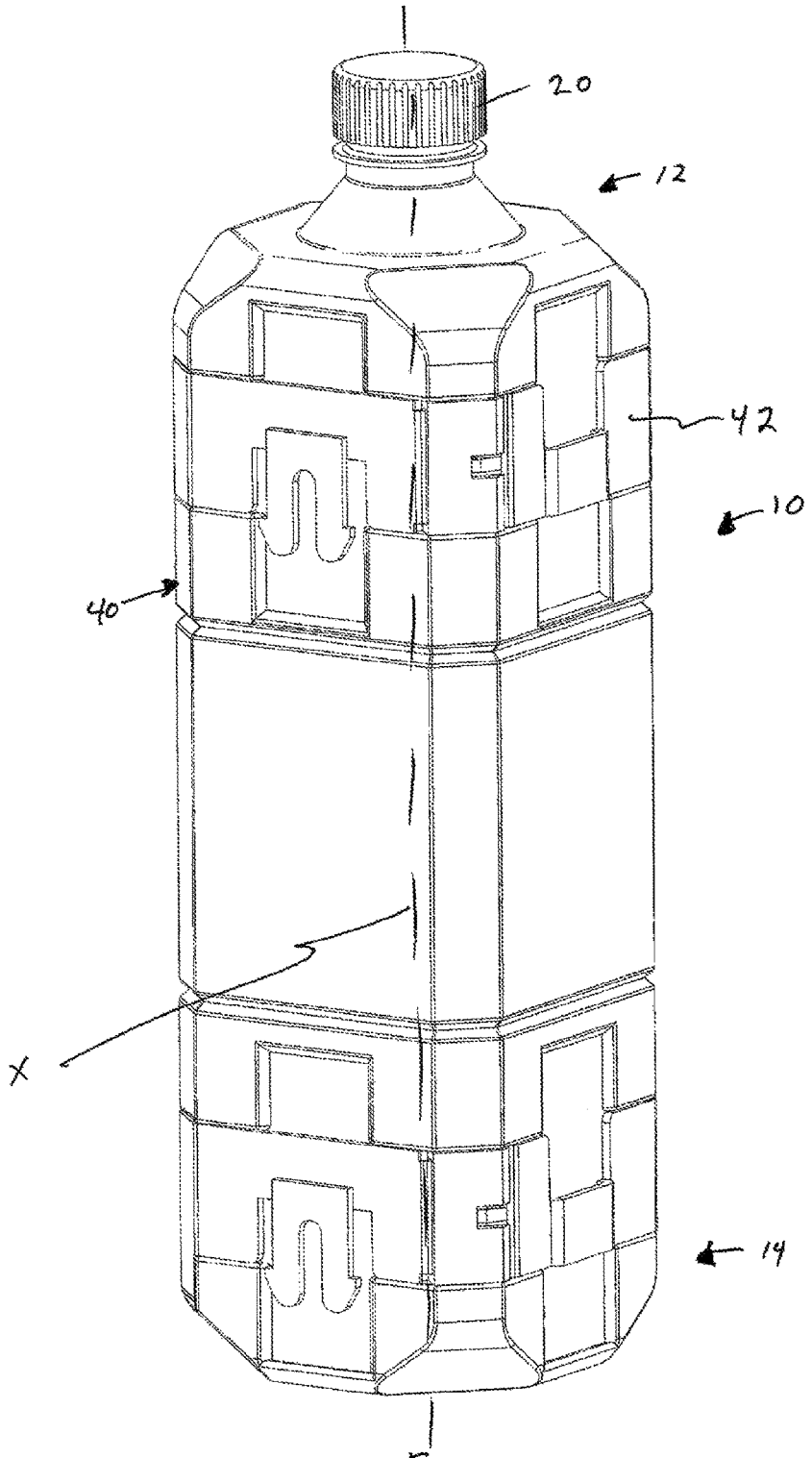

As illustrated in FIGS. 1A and 1B, there is provided a container, which is generally indicated at 10. The container 10 is configured for receiving and storing therein, as well as dispensing, a liquid, such as a beverage. It is further configured for being connected to other similarly constructed containers, for example to form a construction (not illustrated in FIGS. 1A and 1B). The container may be made of plastic, or any other suitable material. It may further be made of more than one material, for example with different functional portions thereof each made from a material most suited to its intended function. The container 10 may further be provided with a liquid, such as a beverage, therein.

It will be appreciated that the term "similarly constructed" when used herein the specification and claims is not to be construed to refer only to containers which are formed with the exact same physical elements thereof, but may also include those containers which are provided with elements which are designed to cooperate with elements thereof.

The container 10 comprises an upper portion 12, a lower portion 14 opposite thereto, and sidewalls 16 extending therebetween. A vertical axis X of the container 10 extends along its height, e.g., extending between the upper and lower portions 12, 14. An opening 18, which may be upwardly-facing, is formed in the upper portion 12 and constitutes a spout of the container 10, e.g., for dispensing therefrom liquid contained therein. A cap 20, configured to be secured to the upper portion 12 such that it closes the opening 18, is provided, thereby facilitating opening and closing of the container 10. The upper portion 12 is thus formed with a closing arrangement 22 configured for cooperating with the cap 20 to facilitate the securing. The closing arrangement 22 may comprise, as shown in FIG. 1A, a threaded cylinder projecting upwardly from the container 10, designed to be screwingly engaged with a corresponding thread (not illustrated) formed on an inside of the cap 20.

It will be appreciated that herein the specification and claims, unless otherwise evident from context, terms related to direction (including, but not limited to, "up", "upper", "upward", "above", "down", "lower", "downward", "below", "sidewardly", "vertically", "horizontally", etc.) are used with reference to an orientation wherein the upper portion 12 of the container 10 is up, and the lower portion 14 of the container is down.

The upper and lower portions 12, 14 of the container 10 are designed so as to facilitate connection of two similarly constructed containers to one another, one atop the other. As such, the upper and lower portions 12, 14 comprise, respectively, upper and lower connecting arrangements, generally indicated at 24 and 26, respectively (illustrated in FIGS. 2 and 3A/3B, respectively), configured to cooperate with one another for facilitating a connection between the supper and lower portions of two containers 10.

Figure 2:
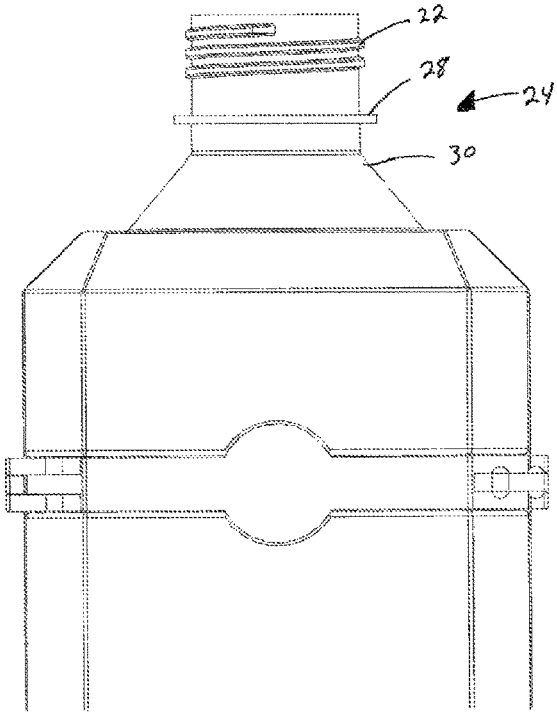
FIG. 2 is a closeup view of an upper portion of the container illustrated in FIGS. 1A and 1B.

According to the example illustrated in FIGS. 1A and 1B, and as better illustrated in FIG. 2, the upper connecting arrangement 24 comprises a lip 28 radially protruding from the upper portion 12, for example from a neck 30 thereof. The lip 28 may be located below the closing arrangement 22 and thus the opening 16 of the container 10. It thus may function not only as the upper connecting arrangement 24, but also, e.g., to aid in dispensing of liquid from the container, by providing a user a means to facilitate supporting the container during pouring.

The lip 28 may be formed integrally with the upper portion 12 of the container 10, and is rigid.

Figure 3A:
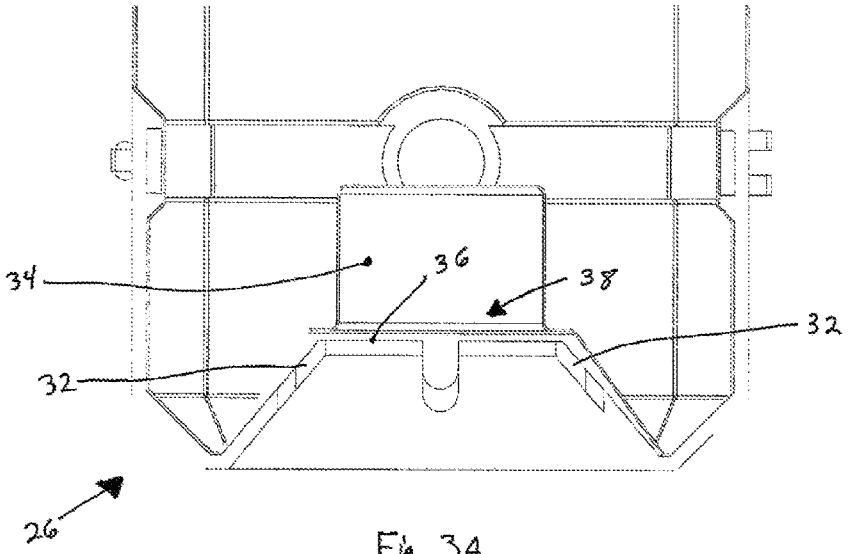
FIG. 3A is a closeup cross-sectional view, taken along line in FIG. 1A, of a lower portion of the container.
Figure 3B:
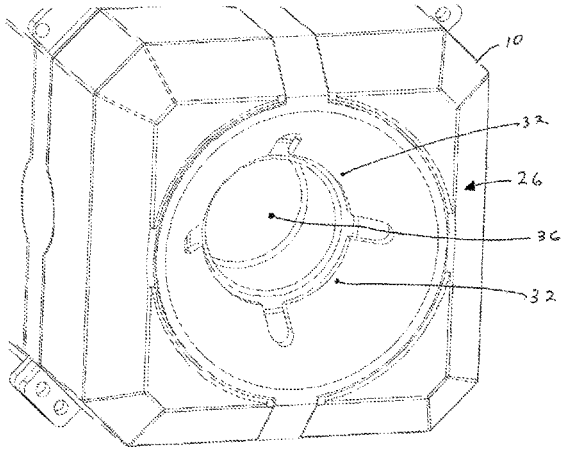
FIG. 3B is a bottom perspective view of the lower portion of the container.

As illustrated in FIGS. 3A and 3B, the lower connecting arrangement 26 comprises a plurality of inwardly directed tabs 32 disposed within a cavity 34 formed in the lower portion 14 of the container 10. The cavity 34 is formed so as to be configured to receive therein at least a top part of the upper portion 12 of the container 10, and in any event allows the lip 28 to pass top edges 36 of the tabs 32. The top edges 36 define a shelf 38, having a diameter which is somewhat smaller than the diameter of the lip 28 of the upper portion 12. In addition, the tabs 32 are flexibly articulated to the lower connecting arrangement 26 and inwardly biased.

In use, when the upper connecting arrangement 24, is inserted upwardly into the cavity 34, the lip 28 thereof pushes the tabs 32 outwardly, owing to the flexible connection thereof to the lower connecting arrangement 26. Once the lip 28 passes (i.e., goes above) the top edges 36 of the tabs 32, the tabs return to their original position due to their inward bias. The shelf 38 defined by the top edges 36 of the tabs 32 block the lip 28 from returning downwardly, thus securing the two containers together.

The cavity 34 may be designed such that when the upper connecting arrangement 24 is received therein as described above, there is minimal space thereabove, thus minimizing the amount of movement (sometimes referred to as "wiggle") between two containers which are so connected.

The sidewalls 16 of the container 10 are designed so as to facilitate connection of two similarly constructed containers to one another, one sidewardly adjacent the other. As such, the container 10 comprises one or more sidewall connecting elements, generally indicated at 40 in FIGS. 1A and 1B, associated with the sidewalls 16 and configured to cooperate with one another for facilitating a connection between sidewardly adjacent containers. The sidewall connecting elements 40 are configured to facilitate the connection to sidewalls associated with similarly constructed sidewall connecting elements.

According to some examples, the sidewall connecting elements 40 may be formed on a band element 42 (illustrated in FIG. 1B), which is snugly disposed about a circumference of the container. Thus, sidewall connecting elements 40 may be added and/or removed from the container 10 as needed. Additionally or alternatively, they may be formed integrally with the sidewall of the container 10.

Figure 4:
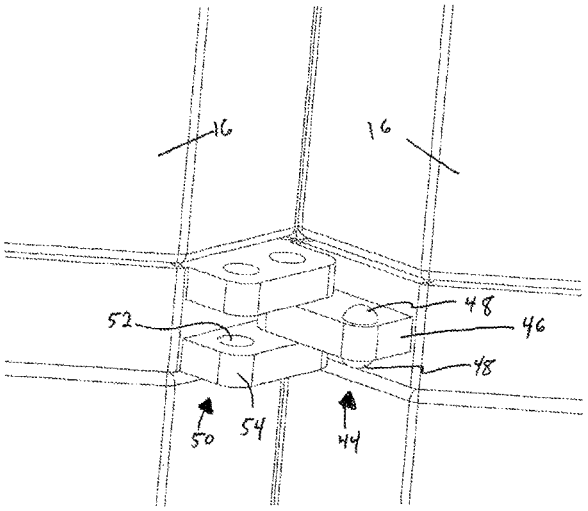
FIG. 4 is a closeup view of sidewall connecting elements of two adjacent containers as illustrated in FIG. 1A, connected to one another.

According to some modifications, the sidewall connecting elements 40 comprise male and female connecting elements. For example, as illustrated in FIG. 4, each male connecting element 44 may comprise a carrying member 46 which protrudes laterally, e.g., outwardly and substantially perpendicularly, from a sidewall of the container 10. The carrying member 46 is formed having one or more rounded protuberances 48 protruding laterally therefrom. The protuberances 48 may protrude upwardly and downwardly, e.g., in a direction substantially parallel to vertical axis X of the container 10, as illustrated in FIG. 4.

It will be appreciated that the carrying member 46 and associated protuberance(s) 48 may be provided according to any suitable configuration (examples of different configurations are not illustrated). According to one non-limiting example, the protuberances 48 may protrude toward the side, e.g., in a direction which is substantially perpendicular to the vertical axis X of the container 10, or in any other suitable direction. According to another non-limiting example, each male connecting element 44 may comprise a carrying member 46 having only one protuberance 48 projecting therefrom, for example with two adjacent male connecting elements each having a single protuberance projecting in a different direction. According to a further non-limiting example, each male connecting element may comprise two protuberances 48 projecting from the carrying member 46, provided such that they are offset from one another. According to a still further non-limiting example, each carrying member 46 may comprise two or more protuberances 48 disposed adjacent one another, e.g., protruding in the same direction.

It will be appreciated that a single container may comprise male connecting elements 44 having carrying members 46 with protuberances 48 according to more than one of the above and/or other examples.

As further seen in FIG. 4, each of the female connecting elements 50 comprises one or more sockets 52 configured to receive therein the protuberances 48 of one of the male connecting elements 44. The sockets 52 may be formed on socket-carrying members 54, as illustrated in FIG. 4. They may be formed through-going, or blind. Alternatively, the sockets 52 may be formed within a recess formed in the sidewall 16 of the container 10 or in the band element 42 snugly disposed about the circumference of the container, as described above.

The male and female connecting elements 44, 50 are each made of a material which facilitates their attachment together, i.e., the receipt and retention of the protuberances 48 within the sockets 52. For example, socket-carrying members 54 may be made of a material which is sufficiently flexible to bend, thereby allowing maneuvering of the protuberances 48 to the sockets 52 when the former is pressed toward the latter (thereby facilitating the receipt), yet stiff enough to retain its position when the protuberances are received with the sockets (thereby facilitating the retention).

Figure 5:
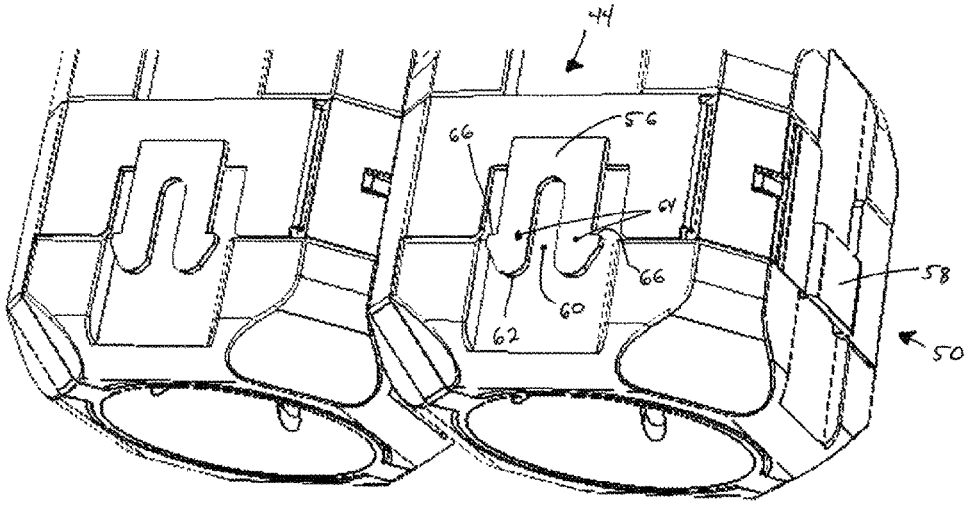
FIG. 5 illustrates an example of sidewall connecting elements of the container illustrated in FIG. 1B.

According to the example illustrated in FIG. 5, each male connecting element 44 comprises a downwardly projecting tab 56, and each female connecting element 50 comprises an upwardly open slot 58 configured to receive and retain therein the tab. According to some modifications, the tab 56 may be designed so as to lock itself within the slot 58 when inserted therein. As such, it may comprise a cutout 60 extending from a free distal end 62 thereof, giving rise to a pair of tongues 64, and stop-arrest arrangements 66 extending sidewardly outwardly from outer sides of the tongues; the slot 58 is open on both (i.e., upper and lower) ends. Accordingly, when the tab 56 is inserted into the upper opening of the slot 58, the tongues 64 are pushed toward each other. When the stop-arrest arrangements 66 clear the lower opening of the slot 58, the tongues 64 return to their original positions, and the stop-arrest arrangements 66 prevent the tab 56 from exiting the slot 58 without manual intervention.

It will be appreciated while the tab 56 described above with reference to FIG. 5 projects downwardly, and the slot 58 is open upwardly, they may be oriented in any suitable manner. For example, the tab 56 may project upwardly and the slot 58 may be open downwardly.

It will be appreciated that the container 10 may comprise both male and female connecting elements 44, 50. According to some examples, they are arranged such that when the container 10 is disposed adjacent a container having the same arrangement of male and female connecting elements 44, 50, the male connecting elements of adjacent sidewalls 16 of each of the containers align with the female connecting elements thereof. According to modifications, the container comprises an even number of sidewall connecting elements disposed at a given position along its height, alternating between male and female connecting elements 44, 50.

Figure 6A:
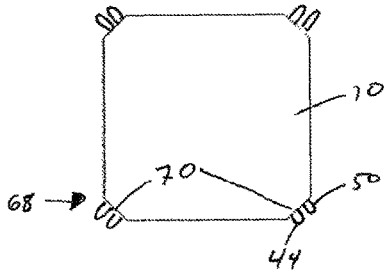
FIGS. 6A through 6C illustrate cross-sectional shapes of examples of containers according to the presently disclosed subject matter.
Figure 6B:
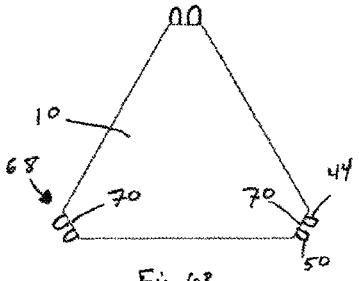
Figure 6C:
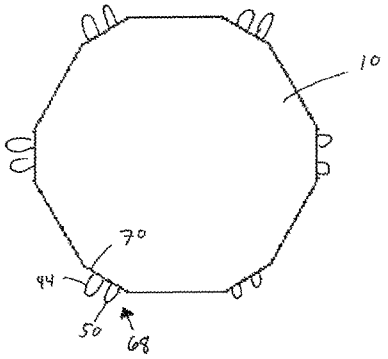

The container 10 may have any suitable cross-sectional (i.e., in a cross-section taken in a plane which is perpendicular to the vertical axis X) shape. For example, as illustrated in FIGS. 6A through 6C, the container 10 may have a major cross-sectional shape (i.e., the general shape thereof discounting minor features, such as the fillet 70, described below) which is suitable for tessellating with the shapes of other similarly formed containers, such as substantially square, triangular, or hexagonal. In addition, each of the vertices 68 of the cross-sectional shape is beveled (or similarly truncated), giving rise to a fillet 70. The male and female connecting elements 44, 50, for example as described above with reference to FIG. 4, may be disposed projecting from the fillet 70, for example with each fillet comprising one each of a male and female connecting element.

It will be appreciated that herein the specification and claims, the term "tessellate" and conjugated forms thereof should be construed to refer to arranging objects having a geometric shape with other objects having the same shape, without overlaps or gaps. Reference to the "major cross-sectional shape" of the container 10 should be construed as the shape the container would have without, e.g., the formation of the fillets 70. Thus, a container having a major shape of a square, but formed with fillets as described above with reference to FIGS. 6A through 6C, may be considered suitable to be tessellated with other similarly shaped containers, as the gaps therebetween are due to the fillets, which do not contribute to the "major cross-sectional shape, and are ignored for the purpose of evaluating its suitability for tessellating.

Figure 7A:
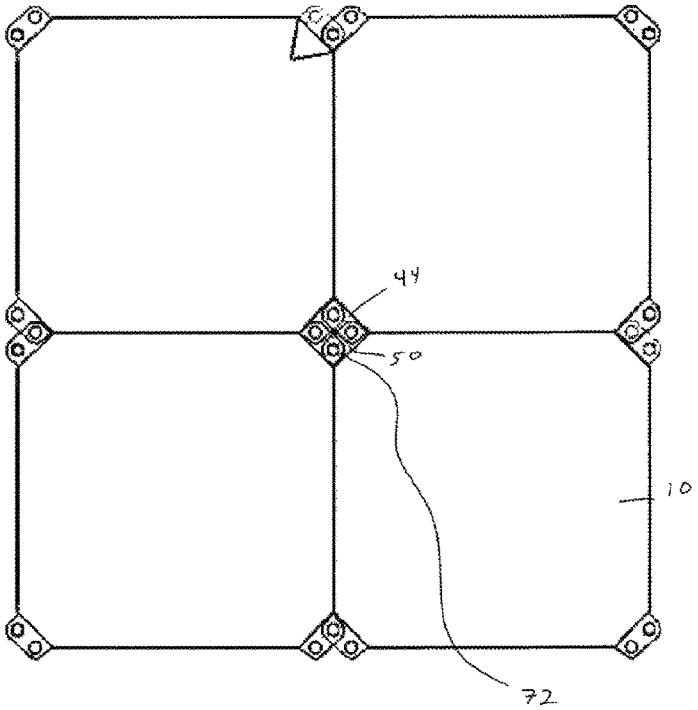
FIGS. 7A through 7C each illustrate several of the containers illustrated in FIGS. 6A through 6C, respectively, connected to one another.
Figure 7B:
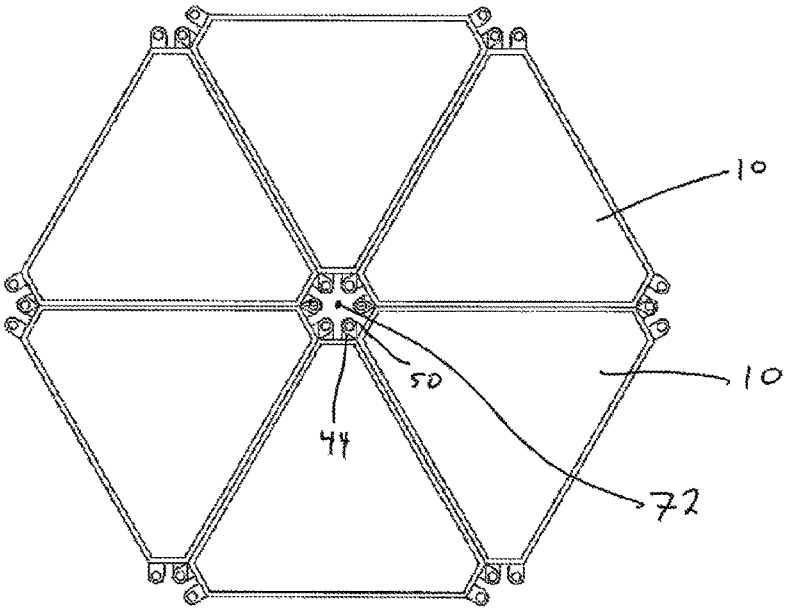
Figure 7C:
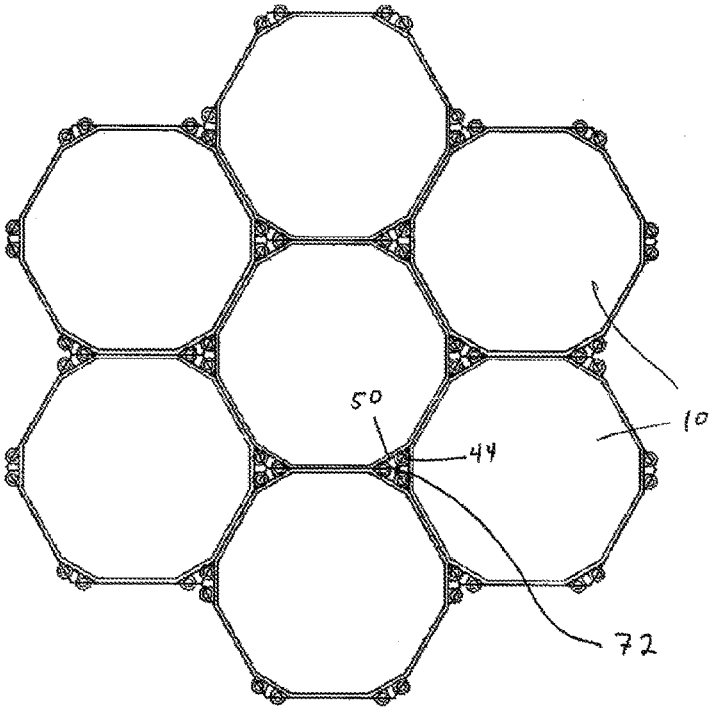

When the containers 10 are tessellated, for example as illustrated in FIGS. 7A through 7C (FIGS. 7A through 7C illustrate tessellations of several of the containers 10 illustrated in FIGS. 6A through 6C, respectively), the adjacent beveled vertices 68 give rise to a void 72 therebetween defined between the fillets 70. The male and female connecting elements 44, 50 project into the void 72 and connect to one another, as described above with reference to FIG. 4, therewithin. Thus, sidewardly adjacent containers 10 constructed according to the examples illustrated with reference to FIGS. 6A through 6C can snuggly abut one another when connected. This facilitates thermal and/or acoustic insulation of a construction made by connecting a plurality of the containers 10.

Figure 8B:
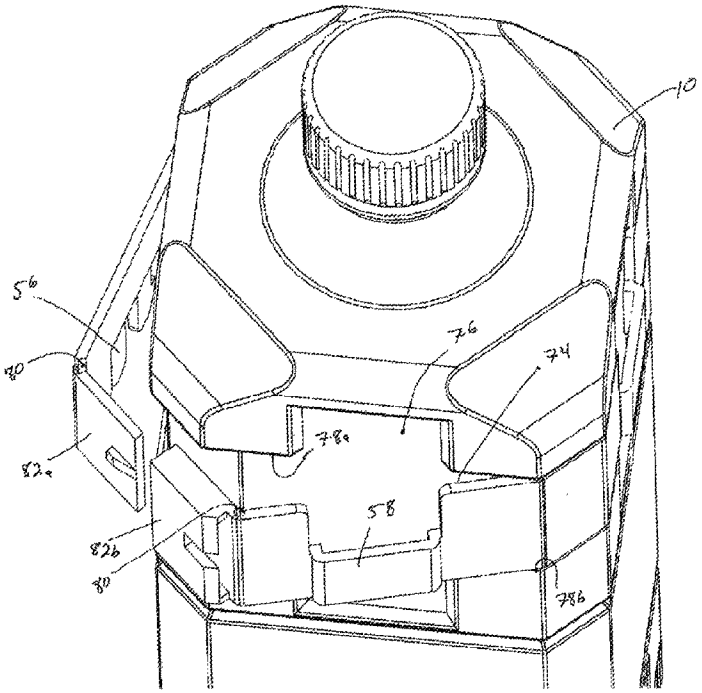
FIGS. 8A and 8B are partial perspective views of the containers according to a modification thereof, with a band element thereof.
Figure 8A:
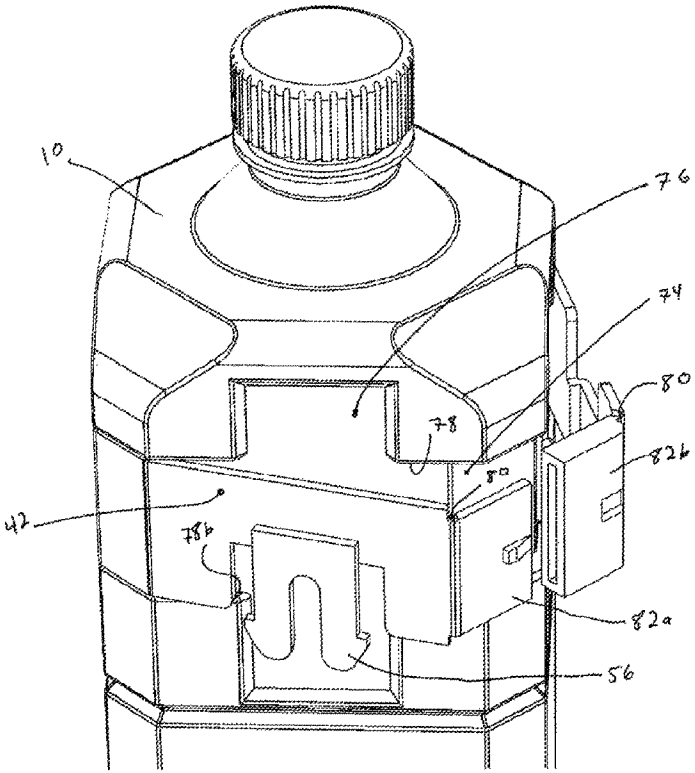

As mentioned above, the sidewall connecting elements 40 may be formed on a band element 42, which is snugly disposed about a circumference of the container. As illustrated in FIGS. 8A and 8B, the container 10 may be formed with one or more circumferential channels 74, each of which may intersect with depressions 76 formed on each side of the sidewall 16. The band element 42 has a shape and thickness which enables it to fit within with the channel 74 and remain flush with the sidewall 16 of the container. The channels 74 comprise with top and bottom edges 78*a*, 78*b* which are formed so as to prevent upward/downward sliding of the band element 42 when received therein. For example, the top and bottom edges 78*a*, 78*b* may be formed, respectively, as downwardly and upwardly facing shelves (i.e., substantially perpendicular to vertical axis X of the container 10) which bear against the band element 42 when experience a vertically-directed force.

The band element 42 is further configured to substantially conform to the cross-sectional shape of the container 10. In order to facilitate this, grooves 80 are provided transverse to the overall length of band element 42, thereby giving rise to living hinges, at suitable locations of the band element, corresponding to corners of the cross-sectional shape of the container. The grooves 80 are formed on a side of the band element 42 which is designed to face the container 10 when disposed thereon.

In addition, the band element may comprise tabs 56 and slots 58, e.g., as described above with reference to FIG. 5, formed thereon and lying in registration over the depressions 76. Accordingly, when sidewardly adjacent containers 10 are connected to one another, the tabs 56 and slots 58 are received within the spaces of the depressions 76, thus not interfering with the snug abutment of the containers to each other.

The band element 42 may further comprises cooperating closing elements 82*a*, 82*b*, formed on opposite ends thereof, which are configured to close the band element 42 about the container 10 within the channel 74.

It will be appreciated that the band element 42 may be formed with male and female connecting 44, 50 elements as described above with reference to FIG. 4, and/or be configured such that, when received within the channel 74, the male and female connecting elements thereof like in registration over fillets of the bottle, mutatis mutandis. Those skilled in the art to which this invention pertains will readily appreciate that numerous changes, variations and modifications can be made without departing from the scope of the invention mutatis mutandis.

Figure 9:
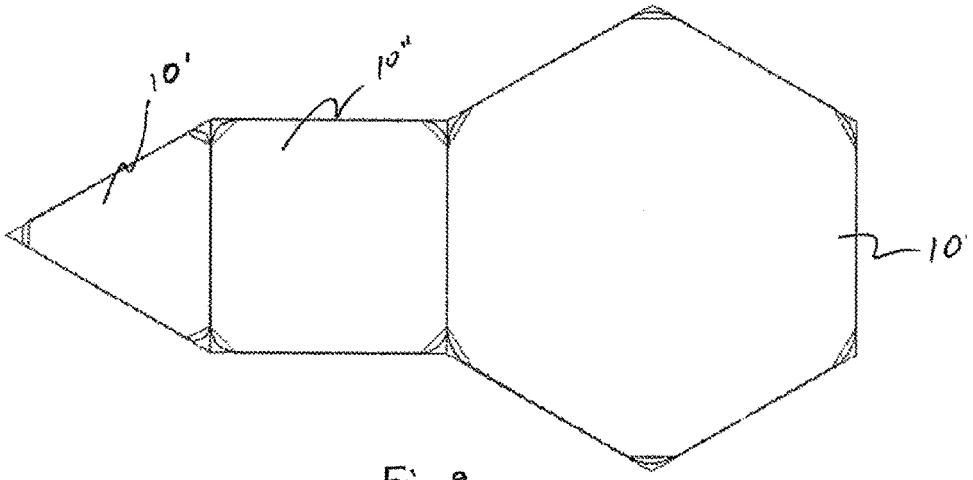
FIG. 9 illustrates how containers according to different examples may be connected to one another.

FIG. 9 is a non-limiting example of containers 10', 10", 10'", each according to a different example (in this case, having cross-sections of different shapes), connected to one another. Accordingly, containers 10 as disclosed herein may be designed to connect to other containers of different designs. In order to facilitate this, the containers should be made having suitable sizes, as is known in the art, mutatis mutandis.

Technical and scientific terms used herein should have the same meaning as commonly understood by one of ordinary skill in the art to which the disclosure pertains. Nevertheless, it is expected that during the life of a patent maturing from this application many relevant systems and methods will be developed. Accordingly, the scope of the terms such as computing unit, network, display, memory, server and the like are intended to include all such new technologies a priori.

The terms "comprises", "comprising", "includes", "including", "having" and their conjugates mean "including but not limited to" and indicate that the components listed are included, but not generally to the exclusion of other components. Such terms encompass the terms "consisting of" and "consisting essentially of".

The phrase "consisting essentially of" means that the composition or method may include additional ingredients and/or steps, but only if the additional ingredients and/or steps do not materially alter the basic and novel characteristics of the composition or method.

As used herein, the singular form "a", "an" and "the" may include plural references unless the context clearly dictates otherwise. For example, the term "a compound" or "at least one compound" may include a plurality of compounds, including mixtures thereof.

The word "exemplary" is used herein to mean "serving as an example, instance or illustration". Any embodiment described as "exemplary" is not necessarily to be construed as preferred or advantageous over other embodiments or to exclude the incorporation of features from other embodiments.

The word "optionally" is used herein to mean "is provided in some embodiments and not provided in other embodiments". Any particular embodiment of the disclosure may include a plurality of "optional" features unless such features conflict.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween. It should be understood, therefore, that the description in range format is merely for convenience and brevity and should not be construed as an inflexible limitation on the scope of the disclosure. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6 as well as non-integral intermediate values. This applies regardless of the breadth of the range.

It is appreciated that certain features of the disclosure, which are, for clarity, described in the context of separate embodiments, may also be provided in combination in a single embodiment. Conversely, various features of the disclosure, which are, for brevity, described in the context of a single embodiment, may also be provided separately or in any suitable subcombination or as suitable in any other described embodiment of the disclosure. Certain features described in the context of various embodiments are not to be considered essential features of those embodiments, unless the embodiment is inoperative without those elements.

Although the disclosure has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the disclosure.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present disclosure. To the extent that section headings are used, they should not be construed as necessarily limiting.

The invention claimed is:

1. A container for receiving therein a liquid, said container comprising an upper portion, a lower portion opposite thereto, and sidewalls extending therebetween and all defining an enclosed volume therewithin, said upper portion comprising an opening to said volume;

said container further comprising a cap configured to be secured to said upper portion for closing said enclosed volume;

said upper portion is configured to connect with the lower portion of a similarly constructed container; and said sidewalls are associated with one or more complementary sidewall connecting elements configured to facilitate connection to sidewalls of similarly constructed containers;

wherein said sidewall connecting elements are formed on a band element snugly disposed about a circumference of the container; and said container is further formed with one or more circumferential channels, each configured to receive therein said band element.

2. The container according to claim 1, wherein said upper portion comprises an upper closing arrangement configured to cooperate with said cap for facilitating its securing thereon and an upper connecting arrangement, wherein said lower portion comprises a lower connecting arrangement configured to cooperate with said upper closing arrangement to facilitate its connection to said upper portion.

3. The container according to claim 2, wherein said upper connecting arrangement comprises a radially-protruding lip, and said lower connecting arrangement comprising a plurality of inwardly-biased tabs.

4. The container according to claim 3, wherein said tabs are disposed within a cavity formed within said lower portion, and configured to receive therein at least a top portion of said upper portion.

5. The container according to claim 3, wherein said tabs each comprise an upper edge, said upper edges defining a shelf having a smaller diameter than said lip.

6. The container according to claim 2, wherein said upper connecting arrangement is disposed below said upper closing arrangement.

7. The container according to claim 1, wherein said sidewall connecting elements comprise at least one of a male and a female connecting element, wherein said male connecting element comprises a carrying member protruding laterally from said sidewall and having at least one rounded protuberance protruding laterally therefrom; and wherein said female connecting element comprises one or more sockets configured to receive therein at least said protuberances of a male connecting element, thereby facilitating the connection to sidewalls of similarly constructed containers.

8. The container according to claim 7, wherein said male connecting element comprises a rounded protuberance protruding in one of an upward and downward direction from said carrying member.

9. The container according to claim 8, wherein said male connecting element comprises two rounded protuberances, one protruding in an upward direction from said carrying member, and one protruding in a downward direction from said carrying member.

10. The container according to claim 7, having a major cross-sectional shape suitable for tessellating and being formed with beveled vertices giving rise to fillets, wherein said sidewall connecting elements are disposed projecting from said fillets.

11. The container according to claim 7, comprising both male and female connecting elements.

12. The container according to claim 7, comprising an even number of sidewall connecting elements disposed at a similar height of the container, wherein said sidewall connecting elements alternate between male and female sidewall connecting elements.

13. The container according to claim 1, wherein said sidewall connecting elements comprise at least one of a male and a female connecting element, wherein said male connecting element comprises a tab, and said female connecting element comprises a slot configured to receive therein said male connecting element.

14. The container according to claim 1, wherein said channel and band element are configured such that said band element is flush with the adjacent sidewall of the container when received within said channel.

15. The container according to claim 1, wherein said channel is formed so as to prevent vertical sliding of the band element when received therein.

16. The container according to claim 15, wherein said channel is defined between top and bottom edges formed as downwardly and upwardly facing shelves.

17. The container according to claim 1, further comprising depressions intersecting with said channel, wherein said band element is formed such that the sidewall connecting elements thereof lie in registration over said depressions when snugly disposed about the container within the channel.

* * * * *